US006050873A

United States Patent [19]

Reisman

[11] Patent Number: 6,050,873

[45] Date of Patent: Apr. 18, 2000

[54] TOY BUILDING BLOCKS

[76] Inventor: Ron Reisman, 5 Hasatat Street, Jerusalem, Israel

[21] Appl. No.: 09/114,561

[22] Filed: Jul. 13, 1998

[30] Foreign Application Priority Data

Jul. 14, 1997 [IL] Israel ..... 121303

[51] Int. Cl.[7] ..... A63H 33/08

[52] U.S. Cl. ..... 446/128; 446/121; 52/604

[58] Field of Search ..... 446/120, 121, 446/124, 128; 52/596, 604, 608

[56] References Cited

U.S. PATENT DOCUMENTS

| | | | |
|---|---|---|---|
| 3,034,254 | 5/1962 | Christiansen | 446/128 |
| 3,566,531 | 3/1971 | Hasel et al. . | |
| 4,238,231 | 12/1980 | Henderson | 446/128 X |
| 4,606,732 | 8/1986 | Lyman | 446/120 |
| 5,057,049 | 10/1991 | Kaczperski | 446/124 X |
| 5,209,693 | 5/1993 | Lyman | 446/128 X |

FOREIGN PATENT DOCUMENTS

| | | | |
|---|---|---|---|
| 499118 | 4/1979 | Australia . | |
| 1315949 | 4/1963 | France . | |
| 506204 | 5/1939 | United Kingdom | 446/121 |
| 1163214 | 9/1969 | United Kingdom . | |

*Primary Examiner*—John A. Ricci

*Attorney, Agent, or Firm*—Brown, Martin, Haller & McClain, LLP

[57] ABSTRACT

The invention provides a toy building block made of a semi-rigid plastic material and joinable to at least one other building block, including a plurality of projections extending from at least one surface of the block, and undercut recesses disposed on the surface opposite to the at least one surface, at least some of which recesses being in substantial alignment with the projections, the projections having a head portion and a neck portion of reduced size and constituting male joining elements, the undercut recesses constituting female joining elements, being at least partial counterparts of the projections, wherein, by application of pressure on two blocks to be joined, elastic deformation of at least the female joining elements will cause the head portions of the male joining elements and the undercut portions of the recesses to snap into mutual engagement.

3 Claims, 5 Drawing Sheets

TOY BUILDING BLOCKS

FIELD OF THE INVENTION

The present invention relates to toy building blocks for use in children's construction sets.

BACKGROUND OF THE INVENTION

Such blocks are known, for instance, the basic Lego® block, a hollow block of various configurations such as, for example, square, rectangular or other shapes, made of a rigid plastic and provided with a number of cylindrical projections that fit with sufficient tightness into the hollow of another block or the hollows of two or more adjacent blocks, thus permitting the building of structures in three dimensions.

Yet while the above-described blocks are successfully used and enjoyed by children above the age of five, smaller children who still lack the required manual dexterity and a sufficient degree of coordination between eyes and fingers, are often frustrated when trying to play with these blocks, even of the non-standard, somewhat larger type. Other children with motor problems and limited coordinative skills include, of course, the physically handicapped.

It is thus one of the objects of the present invention to provide a building block made of a safe, semi-plastic material and of a truly large size, which is easily handled, is provided with snap-in features which facilitate assembly and prevent inadvertent disintegration, and, even in relatively small numbers, can produce impressively large structures.

SUMMARY OF THE INVENTION

According to the invention, the above object is achieved by providing a toy building block made of a semi-rigid plastic material and joinable to at least one other building block, comprising a plurality of projections extending from at least one surface of said block, and undercut recesses disposed on the surface opposite to said at least one surface, at least some of which recesses being in substantial alignment with said projections, said projections having a head portion and a neck portion of reduced size and constituting male joining means, said undercut recesses constituting female joining means, being at least partial counterparts of said projections, wherein, by application of pressure on two blocks to be joined, elastic deformation of at least the female joining means will cause the head portions of said male joining means and the undercut portions of said recesses to snap into mutual engagement.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
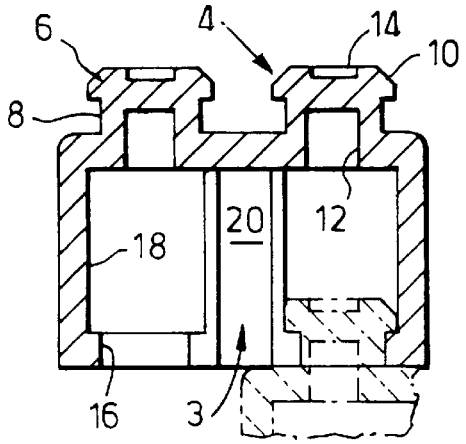
FIG. 1 is an elevational view of a 2×2 projection block according to the present invention, in cross-section along plane I—I of FIG. 2.

Referring now to the drawings, there is seen in the cross-sectional view of FIG. 1 a first embodiment of a building block according to the invention, having a body 2 with a cavity 3 that is open towards, and accessible from, the underside. The upper side of the block is provided with projections 4 (hereinafter, for brevity: "pins"), each of which is seen to consist of a head portion 6 and a neck portion 8 of a reduced diameter, and, in fact, constitutes male-type joining means. For a purpose to be explained further below, the head portions 6 are provided with chamfers 10. Bores 12 and countersinks 14 serve to save material and to prevent sink marks liable to be caused by large differences of material thickness.

Figure 2:
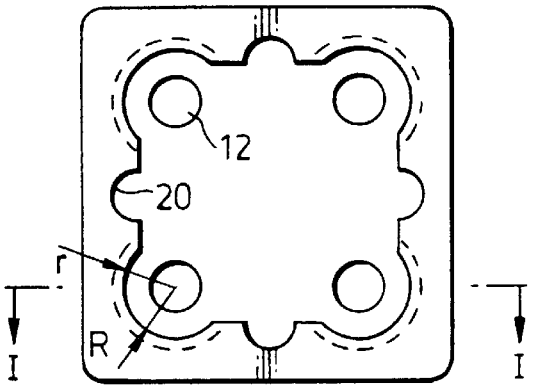
FIG. 2 is a bottom view of the block of FIG. 1.

FIG. 2 shows the bottom side of a first embodiment of the building block according to the invention. It is seen that cavity 3 is mainly defined by, in this embodiment, four undercut recesses, each defined by a lip portion 16 and the undercut portion 18, both constituted by surfaces of imaginary cylinders that are substantially co-axial, i.e., in alignment, with pins 4. Lip portion 16 has a radius r that will fit and accommodate neck portion 8 of a pin 4 of another block, and undercut portion 18 has a radius R that will fit and accommodate head portion 6 of that pin. The undercut recesses clearly constitute female-type joining means.

It is also seen that lip portion 16 subtends an angle of approximately 180° only, so that, by application of slight pressure on a second block, two adjacent pin heads 6 of the latter can be easily made to elastically deform the ends of lip portions 16 of two adjacent recesses of the first block and thus snap into mutual engagement. The required deformation is facilitated by chamfers 10 on heads 6, which chamfers 10 also serve as alignment and guide means. Deformation is further eased by grooves 20 which reduce material thickness around the ends of lip portions 16. Ghosted-in in FIG. 1 is pin 4 of a second block in its snapped-in position.

Figure 3:
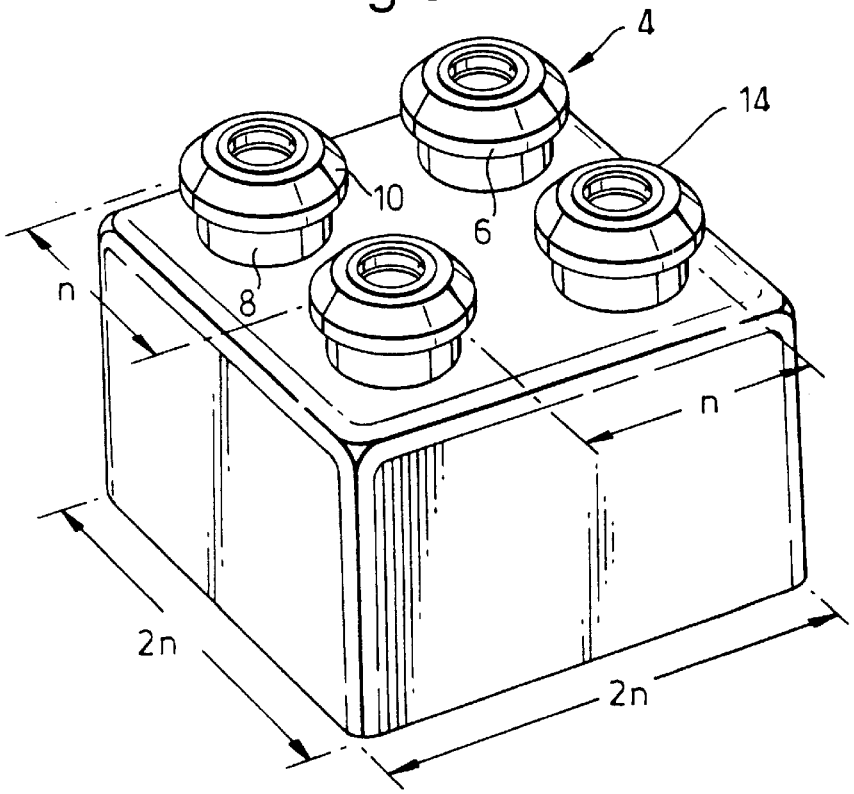
FIG. 3 is a perspective view of the block of FIG. 1.

FIG. 3 is a perspective view of the block of FIG. 1. For identification, this configuration is designated "2×2," i.e., 2 rows of 2 pins each. As can be seen, the dimensions of this configuration are fully modular, which in this context means that the center distance n of pins 4 is the same in the X and the Y directions, and that the width and length of the block are n (in the case of a block of the configuration 1×2 or 1×4, to be shown below) or a multiple of n (in the case of the 2×2 block, 2n). By virtue of this feature, it is for instance possible to build walls, "laying" the "bricks" according to any of the conventional bond schemes, i.e., "stretched bond," in which, in alternating layers, the "bricks" are offset by half their length.

Figure 4:
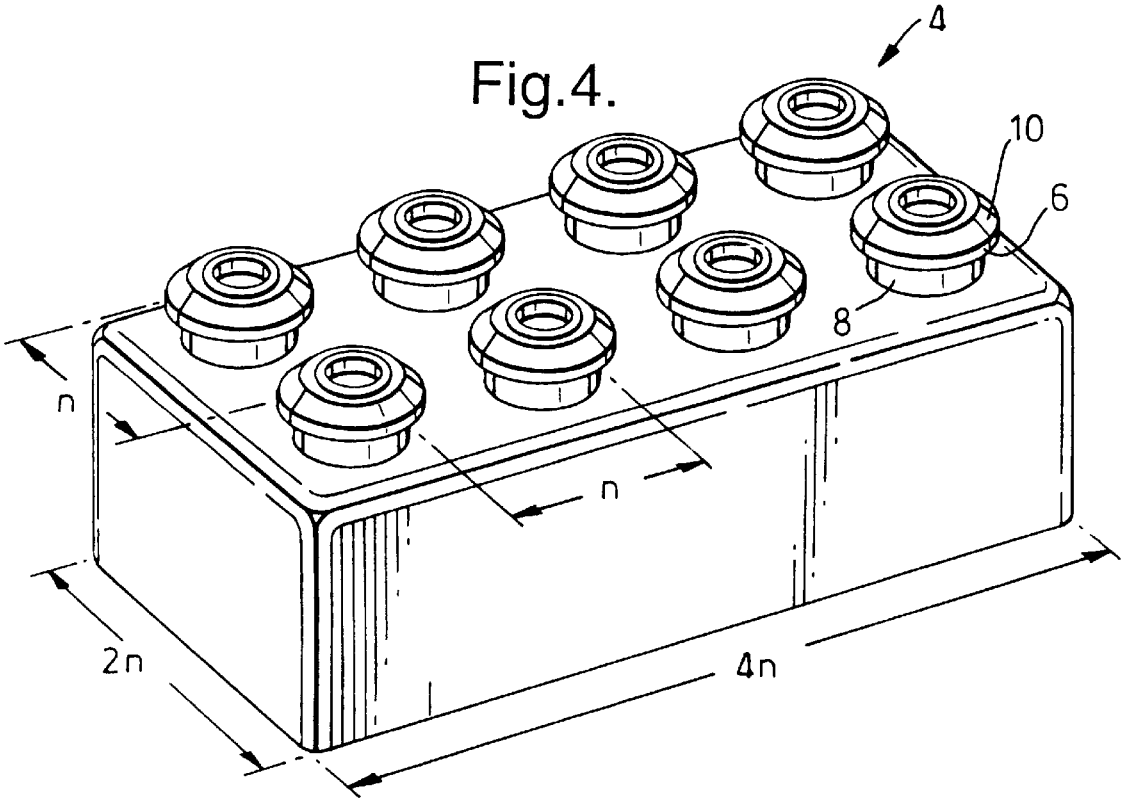
FIG. 4 is a perspective view of a block of the configuration 2×4.
Figure 5:
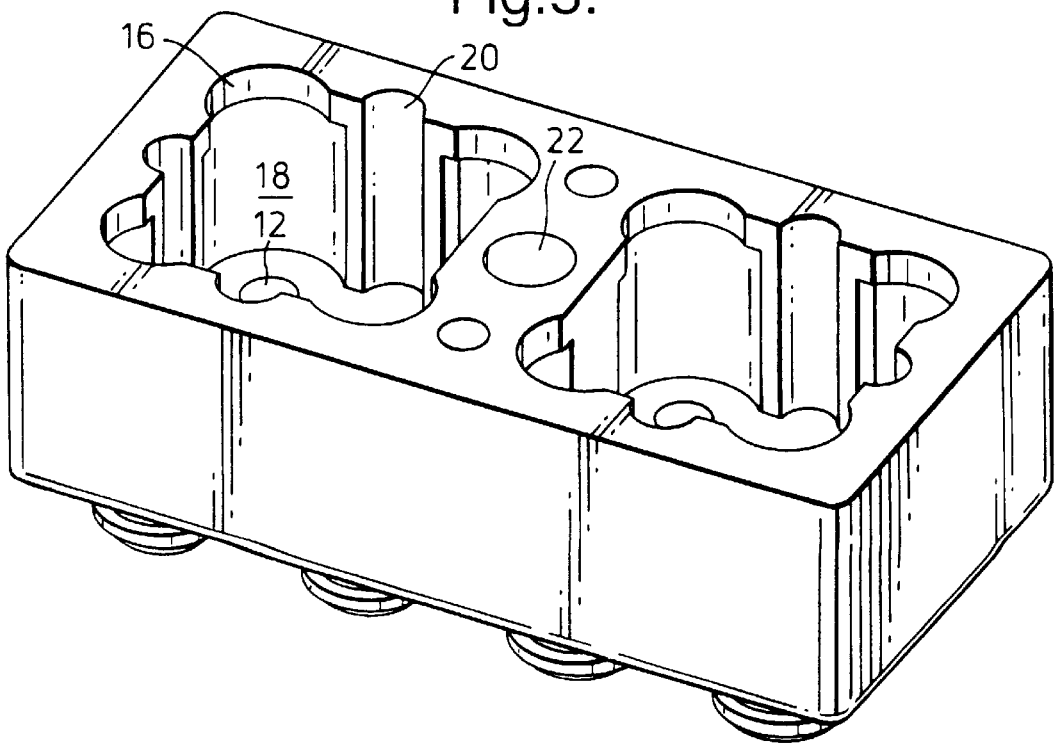
FIG. 5 shows the underside of the block of FIG. 4 in perspective.

FIG. 5 illustrates the underside of the block of FIG. 4. The two cavities are identical with cavity 3 of FIG. 1, bore 22 serving the dual purpose of saving material and increasing the deformability of the ends of lip portions 16.

Figure 6:
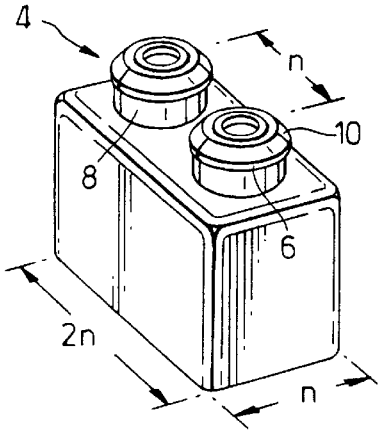
FIGS. 6 and 7 illustrate blocks of the configurations 1×2 and 1×4.
Figure 7:
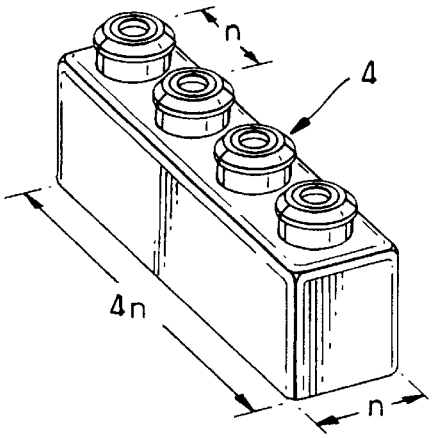

FIGS. 6 and 7 show blocks of the configurations 1×2 and 1×4. also indicating their modularity. Their cavities are analogues of the cavities of blocks 2×2 and 2×4, respectively.

Figure 8:
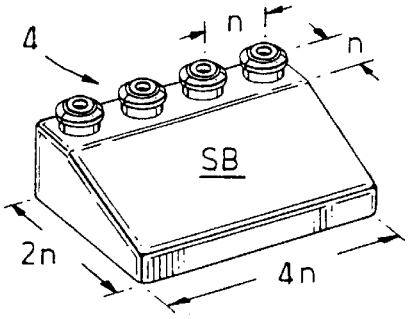
FIGS. 8 to 10 represent blocks with a sloping surface, of the type 1×4, 1×2 and 1×1, respectively.
Figure 9:
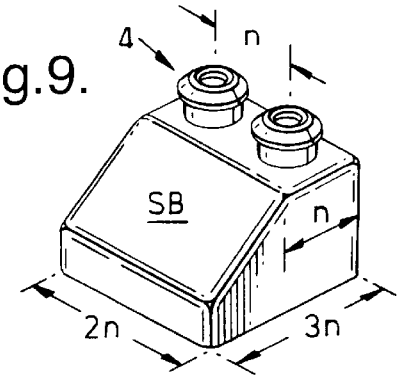
Figure 10:
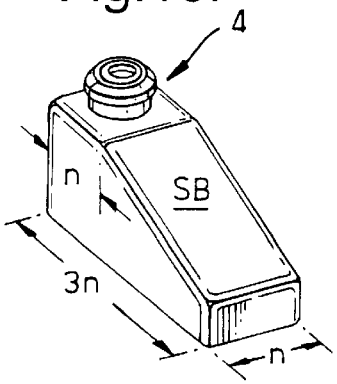
Figure 11:
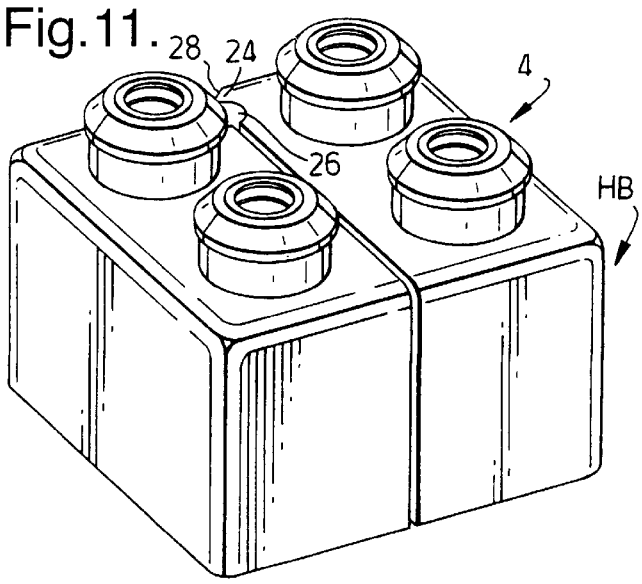
FIGS. 11 and 12 show blocks 2×2 and 2×4 respectively, that are cut almost across their entire width, leaving only a narrow hinge section.
Figure 12:
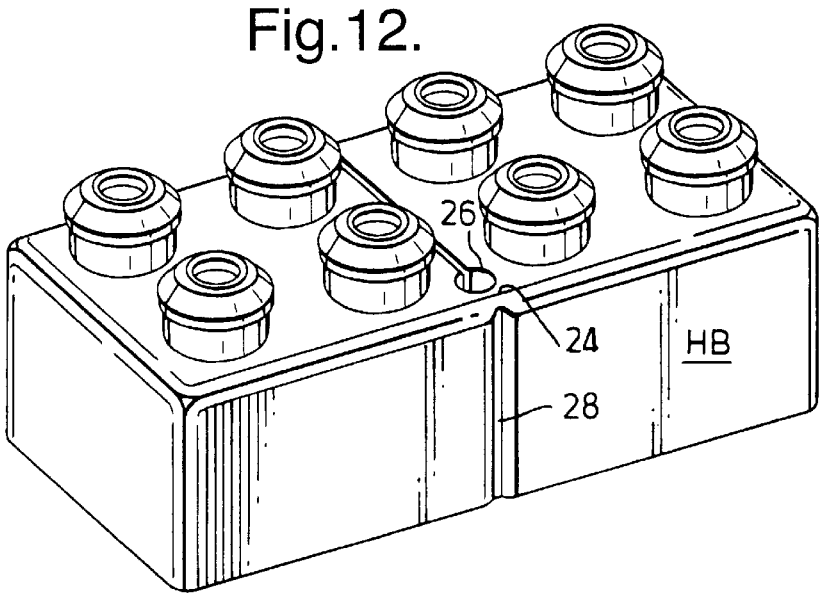

FIGS. 8 to 10 represent blocks having a sloping surface and usable as components of roofs, ramps, etc. These sloping blocks SB are of the type 1×4, 1×2 and 1×1, respectively, and their undersides have 8, 4 and 2 female-type joining means. Their width is 3n; in other words, they would project beyond a block or blocks on which they are mounted, in the way a slanting roof usually projects beyond the walls of a house.

Figure 13:
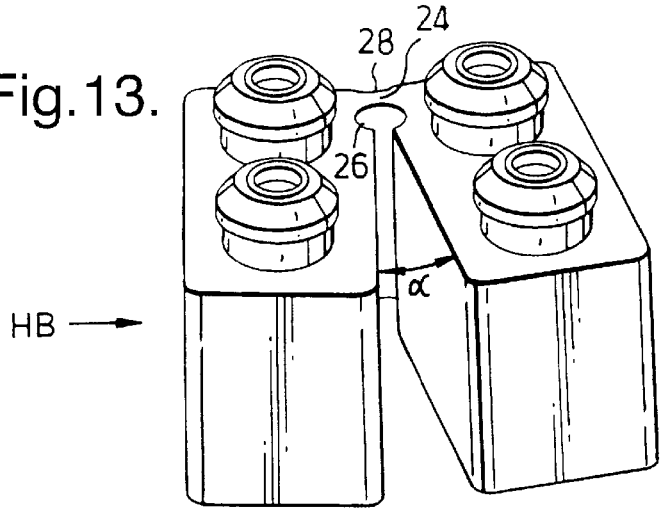
FIGS. 13 and 14 represent the hinged blocks of FIGS. 11 and 12 after having been spread open by an angle $\alpha$.
Figure 14:
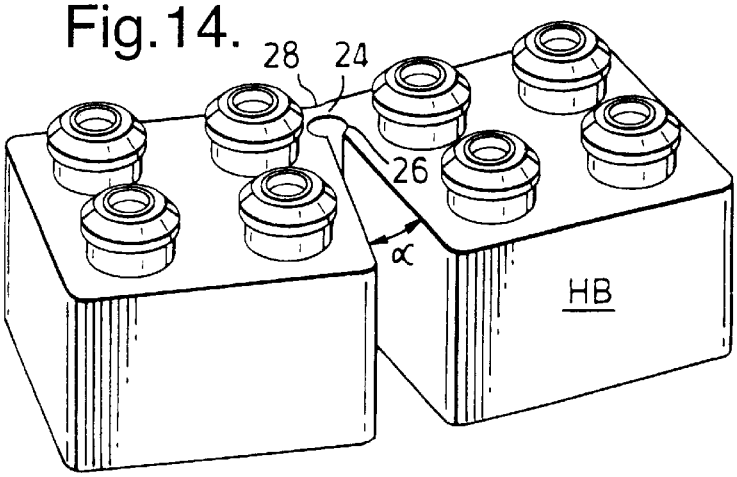

Another type of block is seen in FIGS. 11 to 14. These are hinged blocks HB, consisting of blocks of type 2×2 (FIG. 11) and type 2×4 (FIG. 12) that are cut almost across their entire width and left with a narrow cross-section which serves as a hinge 24, defined on one side by a hole 26 and on the other side by a notch 28. FIGS. 13 and 14 show how these hinged blocks can be spread open, for instance, to build curved walls or cylindrical towers.

Figure 15:
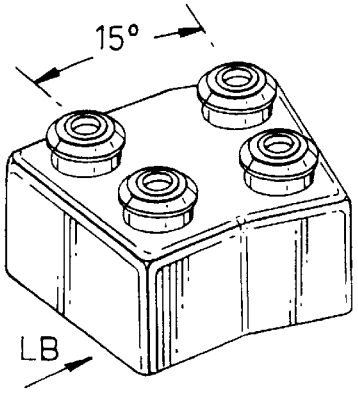
FIGS. 15 to 17 represent locking blocks for immobilizing the hinged blocks of FIGS. 13 and 14 after having been spread open at angles $\alpha$=15°, 30° and 45°, respectively.
Figure 16:
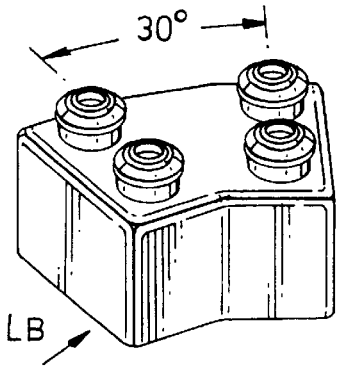
Figure 17:
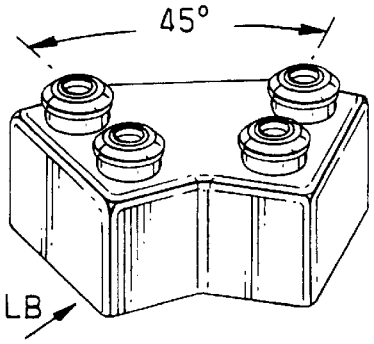
Figure 18:
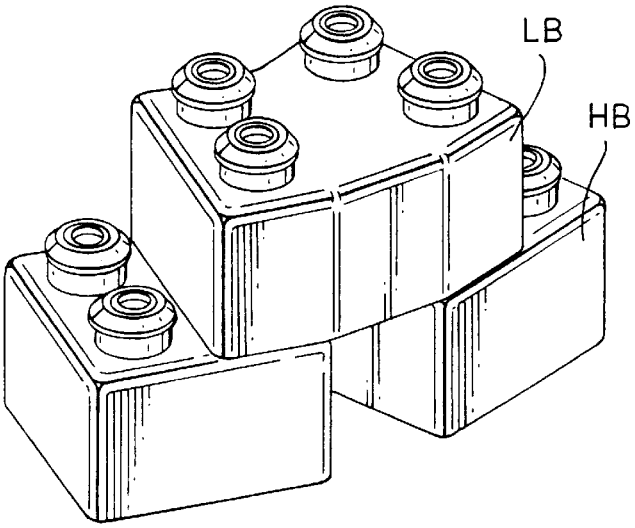
FIG. 18 shows a wall section built with the aid of a hinged block immobilized by means of a locking block.

While for small angles a (see FIGS. 13, 14) friction on the supporting surface is usually sufficient to prevent the blocks from closing on their own due to the elastic restoring force of hinges 24, blocks spread widely open (for larger curvatures) need to be immobilized. For this purpose, there are provided locking blocks LB, shown in FIGS. 15 to 17 and adapted to lock the hinged blocks HB at $\alpha$=15°, 30° and 45°, respectively. Other angles could, of course, also be provided for. Part of a curved wall is shown in FIG. 18, where a hinged block HB is immobilized with the aid of a locking block LB. The bottom layer of the wall would be continued with another hinged block HB locked by means of an LB. The second, locked, HB would then be joined to the first, locked HB by means of a standard 2×2 block introduced between the two LB's.

Figure 19:
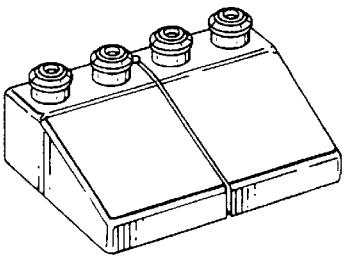
FIGS. 19 and 20 show hinged blocks of the sloping-surface type.
Figure 20:
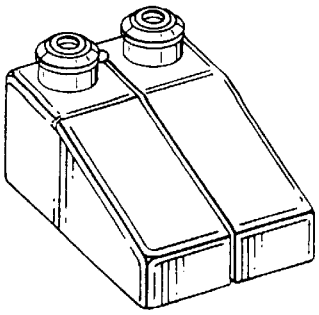

Also provided are HB embodiments of the sloping block (SB) type, as can be seen in FIGS. 19 and 20.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A toy building block made of a semi-rigid plastic material and joinable to at least one other building block, comprising:

a plurality of projections extending from at least one surface of said block, and undercut recesses disposed on the surface opposite to said at least one surface, at least some of which recesses being in substantial alignment with said projections, said projections having a head portion and a neck portion of reduced size and constituting male joining means, said undercut recesses constituting female joining means, being at least partial counterparts of said projections, wherein, in said building block, imaginary vertical planes, passing through center lines of pairs of said projections, include an acute angle with each other.

2. The building block as claimed in claim 1, wherein the head portions of said projections are chamfered.

3. The building block as claimed in claim 1, wherein said block has opposite lateral walls, each lateral wall of said block being substantially parallel to the imaginary vertical plane to which it is adjacent.

* * * * *